United States Patent [19]

Takasawa

[11] Patent Number: 4,764,645

[45] Date of Patent: Aug. 16, 1988

[54] PROCESS FOR MANUFACTURING HORIZONTAL AND VERTICAL TYPE SWITCH DEVICES AND PRODUCTS THEREOF USING COMMON TERMINAL PARTS

[75] Inventor: Kazuhiro Takasawa, Furukawa, Japan

[73] Assignee: Alps Electric Co., Ltd., Japan

[21] Appl. No.: 940,287

[22] Filed: Dec. 11, 1986

[30] Foreign Application Priority Data

Jan. 25, 1986 [JP] Japan ..... 61-12988

[51] Int. Cl.[4] ..... H01H 15/02

[52] U.S. Cl. ..... 200/16 F; 29/622; 29/883; 29/884; 200/16 D; 200/254

[58] Field of Search ..... 29/622, 418, 883, 884, 29/842–844, 846–848; 264/272.14, 272.15; 200/16 D, 16 F, 254; 439/736

[56] References Cited

U.S. PATENT DOCUMENTS 4,075,442 2/1978 Fukuda et al. ..... 200/16 F
4,536,953 8/1985 DeVera ..... 29/622
4,595,805 6/1986 Masuda ..... 29/622
4,687,887 8/1987 Stokoe et al. ..... 200/16 F

*Primary Examiner*—P. W. Echols
*Attorney, Agent, or Firm*—Guy W. Shoup; Paul J. Winters; Leighton K. Chong

[57] ABSTRACT

A process for selectively manufacturing vertical or horizontal type switch devices using a common form for substantially all parts or components, and products manufactured by the same process. The process comprises subjecting a metallic strip to stamping-out to leave predetermined patterns, each pattern consisting of a set of fixed contact elements, and two groups of terminals extending from the fixed contact elements and perpendicular to each other, and passageways between adjacent terminals in part; cutting some selected sites from the passageways so that one desired group of terminals in accordance with horizontal or vertical type may remain connected to the fixed contact elements before or after the molding with an insulating synthetic resin so that each resulting pattern may be inserted in the mold formed thereby; and making assembly of the thus-obtained mold-with-terminal-pattern and other parts and components.

3 Claims, 9 Drawing Sheets

PROCESS FOR MANUFACTURING HORIZONTAL AND VERTICAL TYPE SWITCH DEVICES AND PRODUCTS THEREOF USING COMMON TERMINAL PARTS

BACKGROUND OF THE INVENTION

1. Field of the Invention

This invention relates to a process for manufacturing switch devices and products manufactured by the same process, and more particularly to a process for selectively manufacturing vertical or horizontal type switch devices using a common form for substantially all parts or components, and products manufactured by the same process.

2. Description of the Prior Art

For example, push button switches can be divided into two types called vertical and horizontal from the view point of the positional relation of the terminals extruding from the mold to the movement direction of the slide carrying the so-called movable contact element. The so-called vertical type is of such relation that the terminals protrude parallel to the movement direction of the slide, and usually is attached to a chassis by being forced vertically downwards. The other so-called horizontal type is of such construction that the terminals protrude from the mold perpendicular to the movement direction of the slide, and may be pushed in parallel to the chassis.

In the prior art, the types are manufactured by the assembly of a mold with terminal patterns slide, frame, etc., which are different depending on whether they are for the horizontal or vertical type.

Problem to be solved by the invention

In the above-described prior art however is encountered the problem that such assembly is still unsatisfactory because it is necessary to provide two series of other components or parts and respective assembly lines, resulting in high costs of parts and for assembly.

In view of the above-stated problem concerned with the prior art, the present invention has been accomplished. It is an object of the invention to provide a process of permitting selective manufacture of both types not only using most parts in the common form but also commonly over greatly widened range of assembly steps, contributing to reduction of manufacturing cost. Another object is to provide horizontal and vertical type switch devices manufactured by the manufacturing process according to the invention.

Means for solving the problem

The above-stated problem can be solved and the aforesaid object is attainable by the construction according to the invention that a switch device comprises a metallic pattern molded piece, the pattern having one group of terminals connected to a set of fixed contact elements, a movable contact element brought slidably into or out of contact with the fixed contact elements, and a slide, the opening and closing of circuits being made by the operation of the slide, and the group of terminals being left by cutting some sites in the pattern selected in accordance with the direction of sliding of the slide.

Switch devices of the above-described construction according to the invention are manufactured in the following process comprising the following steps:

(a) subjecting a metallic electrically-conductive strip to stamping-out to leave predetermined patterns, each pattern consisting of a set of fixed contact elements, and two groups of terminals extending from the fixed contact elements and perpendicular to each other, and passageways between adjacent terminals in part;

(b) cutting some selected sites from the passageways so that one desired group of terminals may remain connected to the fixed contact elements;

(c) molding with an insulating synthetic resin so that each resulting pattern may be inserted in the mold formed thereby;

(d) cutting the ends of the group of terminals remaining connected to the fixed contact elements and cutting off substantially the other group of terminals not connecting to the fixed contact elements, thus separating mold-with-terminal-pattern pieces from the metallic strip, and (e) installing a slide for carrying a movable contact element and a frame for holding the slide therein and defining the sliding range of the slide, to permit the movable contact element to move slidably into or out of engagement with the set of fixed contact elements.

There is an alternative process comprising the steps:

(a) the same as paragraph (a) in the preceding process;

(b) the same as paragraph (c) in the preceding process;

(c) cutting predetermined sites in the pattern together with the portion of the mold just covering the sites to leave one group of terminals connecting to the fixed contact elements;

(d) the same as paragraph (d) in the preceding process; and (e) the same as paragraph (e) in the preceding process.

Advantages afforded by the invention

The construction according to the invention set forth above enables selective manufacture of horizontal or vertical switch device merely by cutting the corresponding sites in the terminal pattern to selected types using in the common form for substantially all parts or components including terminal pattern, mold, movable contact element, slide, frame, etc.

Besides the above-described processes according to the invention permits either horizontal or vertical type switch devices to be manufactured in an entirely common assembly process only by changing sites in the terminal pattern to be cut.

DESCRIPTION OF PREFERRED EMBODIMENTS OF THE INVENTION

Figure 1:
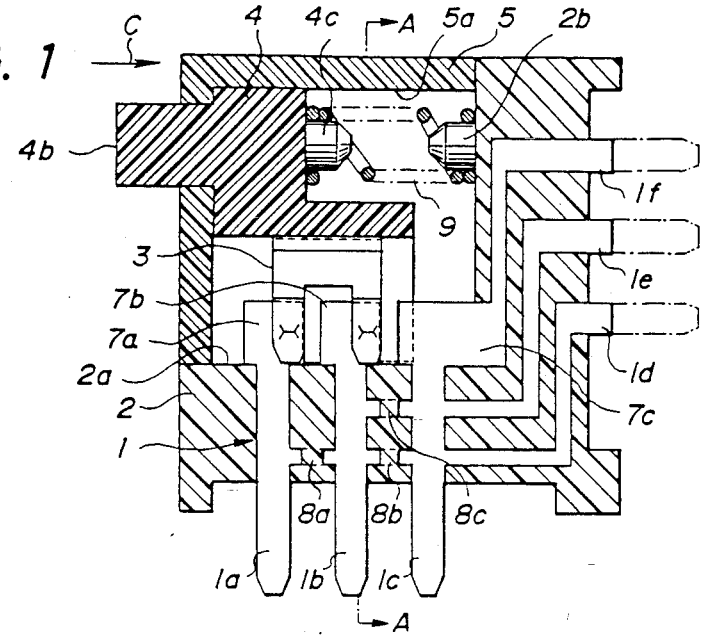
FIG. 1 is a cross-sectional view of the internal structure of a horizontal-type switch device according to the invention.
Figure 2:
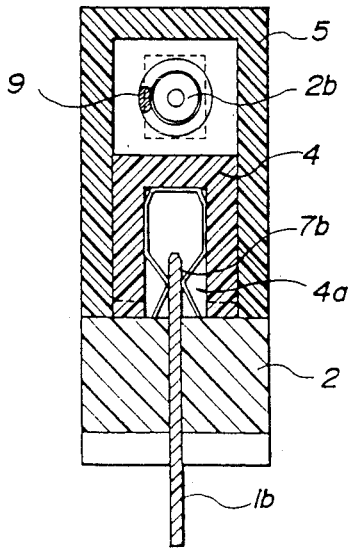
FIG. 2 is a cross-sectional view taken along line A—A of FIG. 2.
Figure 3:
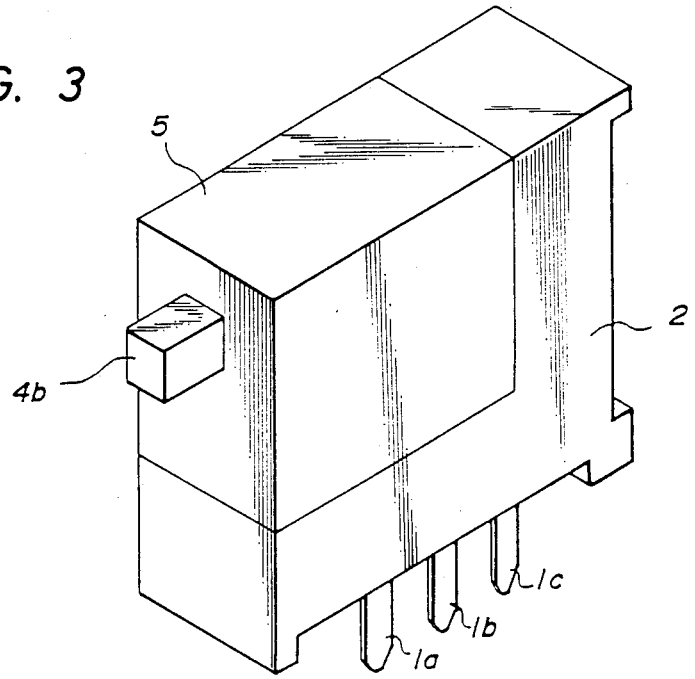
FIGS. 3 and 4 are perspective views in different directions of the whole structure of the switch device of FIG. 1.
Figure 4:
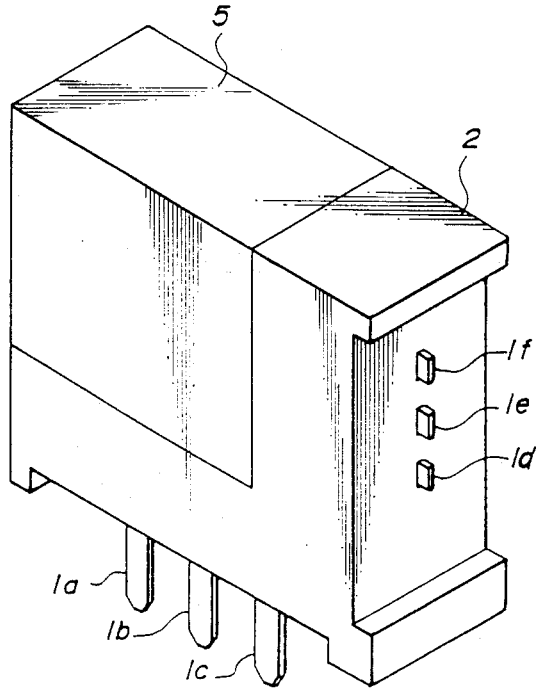

Referring to FIGS. 1 through 8, switch devices according to the invention are originally regarded as being essentially constructed of a patterned terminal plate with two groups of three terminals 1*a*, 1*b*, 1*c*; 1*d*, 1*e*, 1*f*, respectively; perpendicular to each other, a bracket-shaped mold 2 integrated with the terminal groups inserted with their end portions protruding therefrom; a slide 4 carrying a movable contact element 3, and a frame 5 in which the slide 4 is movable along the pathway defined thereby.

Figure 9:
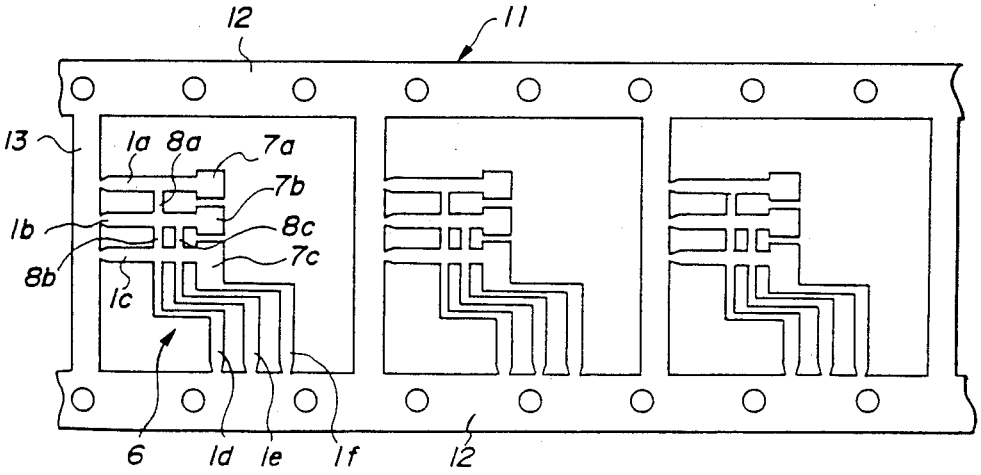
FIG. 9 is a plan view of a metallic strip with terminal patterns left.

In the terminal section 1, a metallic terminal pattern 6, as illustrated in FIG. 9, comprises fixed contact elements 7*a*, 7*b*, and 7*c* just above the terminals 1*a*, 1*b* and 1*c* (FIG. 1), or on the right side (FIG. 5) and passageway 8*a* interconnecting the terminals 1*a* and 1*b* and two passageways 8*b* and 8*c* interconnecting the terminals 1*b* and 1*c*. In this way, the fixed contact elements 7*a*, 7*b*, 7*c* and two terminal groups 1*a*, 1*b*, 1*c*; 1*d*, 1*e*, 1*f* are connected to each other. In accordance with vertical or horizontal type, the passageways 8*a*, 8*b*, 8*c*; or sites 10*a*, 10*b*, 10*c*; in the terminal 1*b*, 1*c* are cut to leave either the terminal group 1*a*, 1*b*, 1*c*; or 1*d*, 1*e*, 1*f*; to be connected to the corresponding fixed contact elements 7*a*, 7*b*, 7*c*. The fixed contact elements 7*a*, 7*b*, 7*c* are projected by a finite length from the mold 2 and the middle fixed contact element 7*b* is designed to function as a common contact.

The movable contact element 3 is secured to the lower surface (FIG. 1) or the right surface (FIG. 5) of the slide 4 to be carried by it, and can be brought into or out of engagement with the fixed contact elements 7*a*, 7*b*, 7*c* to tightly grip them.

The slide 4 is made of insulating synthetic resin material, provided with a cavity 4*a* in which the movable contact 3 is fitted, on the lower portion (FIG. 1) or on the left portion (FIG. 5), a handle to be pushed 4*b* on the left side (FIG. 1) and on the upper side (FIG. 5), and a projection 4*c* on the right side surface (FIG. 1) or at the lower end surface (FIG. 5) engaged with a compression spring 9. The slide 4 is permitted to slide on surface 2*a* of the mold 2 from which the fixed contact elements 7*a*, 7*b*, 7*c* project, with the lower end (FIG. 1) or the left surface (FIG. 5) of the cavity (4*a*) kept in contact with the surface 2*a* of the mold 2.

The mold 2 is similarly made of insulating synthetic resin and has a bracket-like shape of which sides surround the terminal groups 1*a*, 1*b*, 1*c*; 1*d*, 1*e*, 1*f*, respectively, in the form of a belt. Besides, the mold 2 is provided with a projection 2*b* located oppositely to the projection 4*c* of the slide 4 so as to install the compression spring 9 between them.

Figure 5:
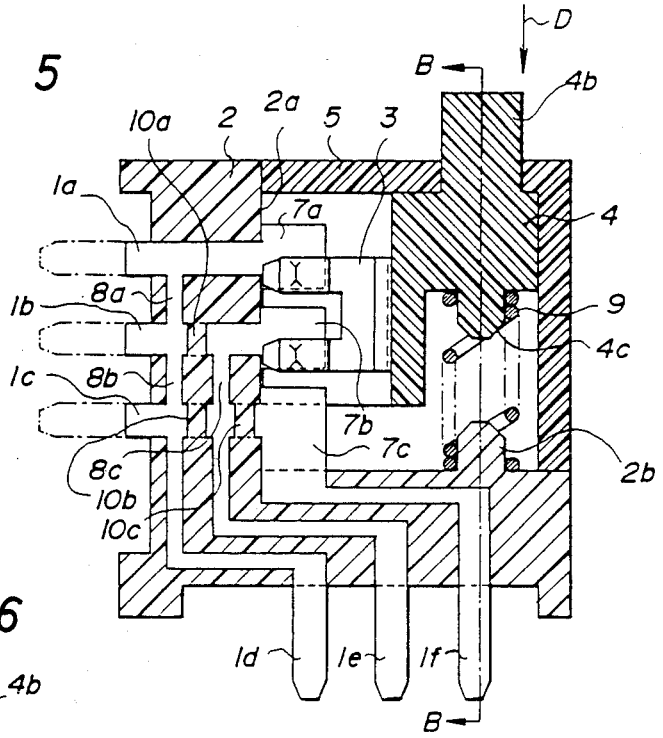
FIG. 5 is a cross-sectional view of the internal structure of a vertical-type switch device according to the invention.
Figure 6:
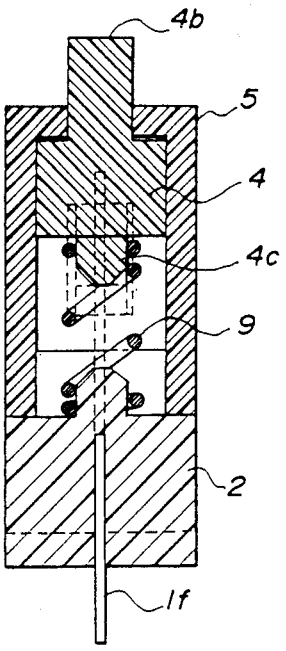
FIG. 6 is a cross-sectional view taken along line B—B of FIG. 5.
Figure 7:
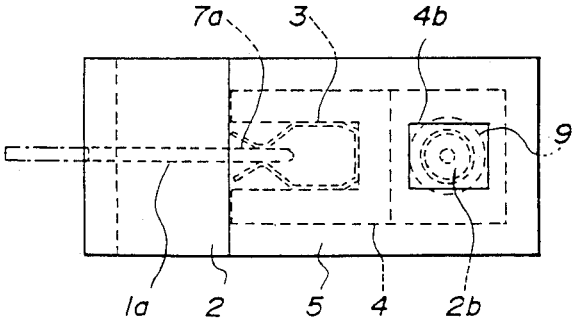
FIG. 7 is a plan view of the vertical-type switch device of FIG. 5.
Figure 8:
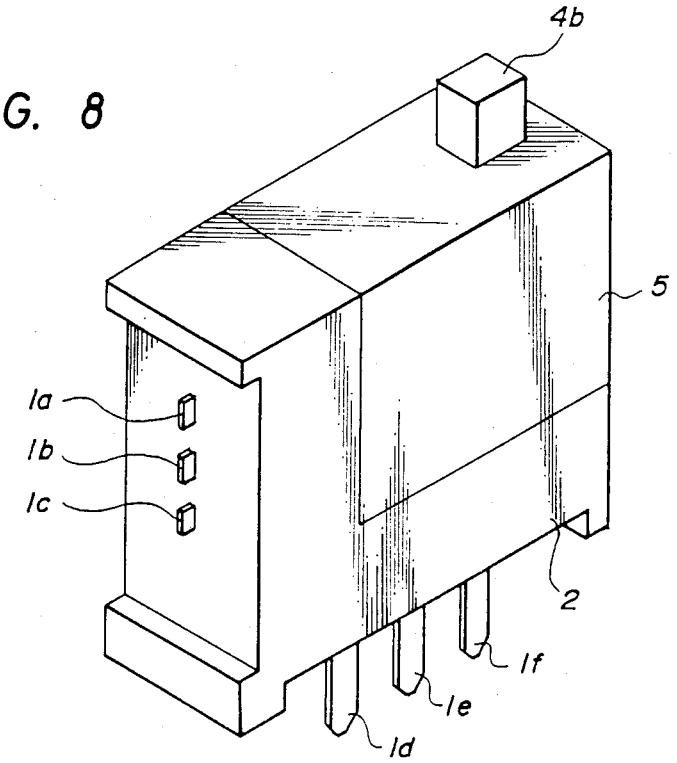
FIG. 8 is a perspective view of the entire structure of the vertical-type switch device of FIG. 5.

The frame 5 with the slide 4 in the cavity is mounted on the mold 2 at the left-upper location (FIG. 1) or at the right upper location (FIG. 5). The slide 4, when the handle 4*b* protruding through the side of the frame 5 is pushed, is caused to move in the direction of arrow C against the resilience of the compression spring 9 along the pathway defined by the slide surface 2*a* of the mold and the slide surface 5*a* of the frame 5. This sliding of the slide shifts the movable contact element 3, resulting in the interconnection between the fixed contact elements 7*a* and 7*b*, or between 7*b* and 7*c*, and thereby opening and closing of desired circuits can be operated.

In the following, the description of the differences between the horizontal and vertical types of switch devices will be given:

As described above, FIGS. 1 through 4 illustrate a horizontal type switch device according to the invention, in which the passageways 8*a*, 8*b*, 8*c* in the terminal pattern 1 are cut so as to separate the fixed contact elements 7*a*, 7*b* and 7*c* from the terminals 1*a*, 1*b*, and 1*c* through 1*f*, respectively, and the terminals 1*d*, 1*e*, 1*f* protruding rightwards from the mold 2 are substantially cut off. This type therefore has only the terminals 1*a*, 1*b* 1*c* which extends in the direction perpendicular to the sliding direction of the slide 4 indicated arrow C and protruding through the mold 2, and are projected, for example, into a printed chassis to perform a predetermined wiring.

On the other hand, FIGS. 5 through 8 illustrate a vertical type switch device according to the invention, in which a site 10*a* of the terminal 1*b* and sites 10*b* and 10*c* of the terminal 1*c* in the terminal pattern 1 are cut so as to separate the fixed contact elements 7*a* and 7*c* from terminals 1*a* through 1*d*, and fixed contact element 7*b* from terminal 1*f*, and fixed contact element 7*c* from terminal 1*e*, respectively, and the terminals 1*a*, 1*b*, 1*c* protruding leftwards from the mold 2 are substantially cut off. This type therefore has only the terminals 1*d*, 1*e*, 1*f* which extend from the fixed contact elements 7*a*, 7*b*, 7*c* in the direction parallel to the sliding direction of the slide 4 indicated arrow D and protruding through the mold 2, and are projected, for example, into a printed chassis to perform a predetermined wiring.

In this way, both types, horizontal and vertical, switch devices are manufacturable with substantially all parts in the common form merely by sectioning at appropriate sites in the terminal pattern 6 and substantially cutting unnecessary terminals off, thus enabling great reduction in costs of parts and for manufacture.

The process for manufacturing the above-described switch devices will be set forth hereinafter:

In the first step for the manufacture of the above-described switch devices according to the invention, a metallic conductive strip 11 as of brass is provided with boreholes along each edge 12 and is subjected to successive stamping so that ribs 13 and predetermined terminal patterns 6 are left. The terminal pattern 6, as described above, comprises the terminal group 1*a*, 1*b*, 1*c* extending in one direction from the fixed contact elements 7*a*, 7*b*, 7*c*; the other terminal group 1*d*, 1*e*, 1*f* extending perpendicularly to the terminal group 1*a*, 1*b*, 1c; the passageway 8a between the terminals 1a and 1b; and the passageways 8b, 8c between the terminals 1b, 1c and in the extension of the terminals 1d, 1e respectively. The terminal patterns 6 are continuous through the terminals 1d, 1e, 1f with one edge 12 and through terminals 1a, 1b, 1c with the ribs 13.

Figure 10A:
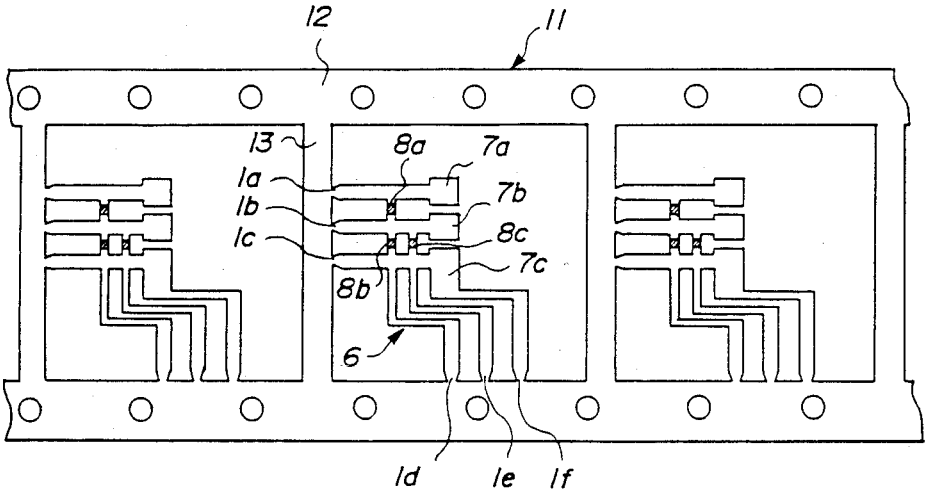
FIGS. 10*a* and 10*b* are similar plan views where sites to be cut in the terminal pattern are highlighted for horizontal and vertical types, respectively.
Figure 10B:
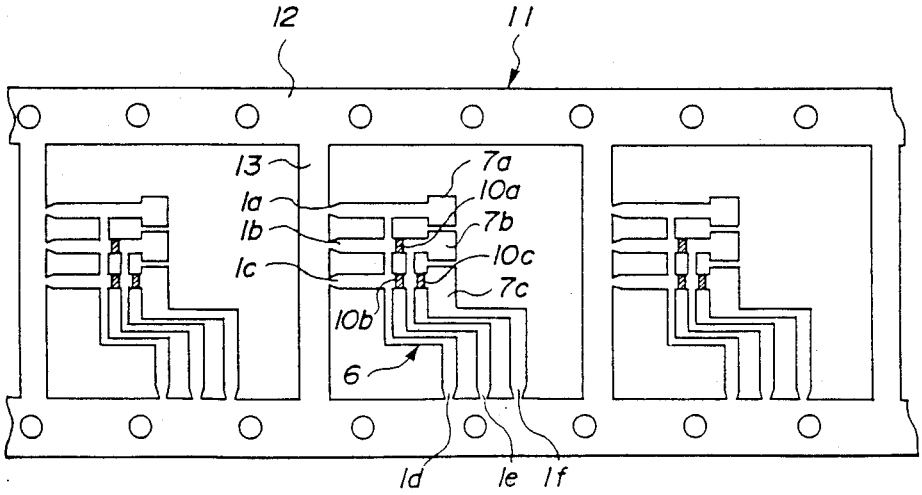

The second step is outlined as follows: appropriate sites in the terminal pattern 6 are cut to allow the fixed contact elements 7a, 7b, 7c to connect to either terminal group 1a, 1b, 1c or 1d, 1e, 1f. For horizontal type, the passageways 8a, 8b, 8c shown in FIG. 10a are cut, and thus the fixed contact elements 7a and 7b connect only with the corresponding terminals 1a and 1b, and the fixed contact element 7c connects with the terminals 1c, 1d, 1e, 1f. For vertical type, the passageways 10a, 10b, 10c shown in FIG. 10b are cut, the fixed contact element 7a connects with the terminals 1a, 1b, 1c, 1d, and the other fixed contact elements 7b and 7c connect only with the corresponding terminals 1e and 1f, respectively.

Figure 11A:
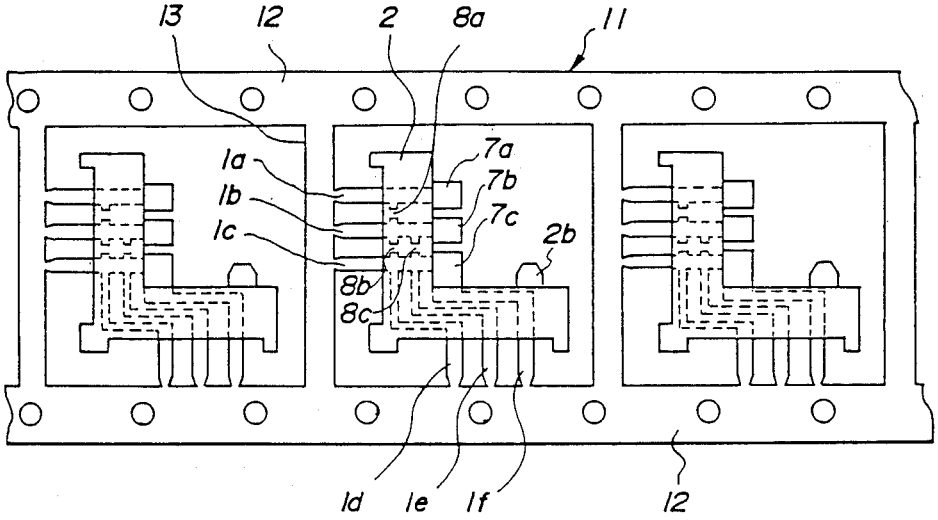
FIGS. 11*a* and 11*b* are similar views, but the terminal patterns are integrated with a shaped mold for the horizontal and vertical types, respectively.
Figure 11B:
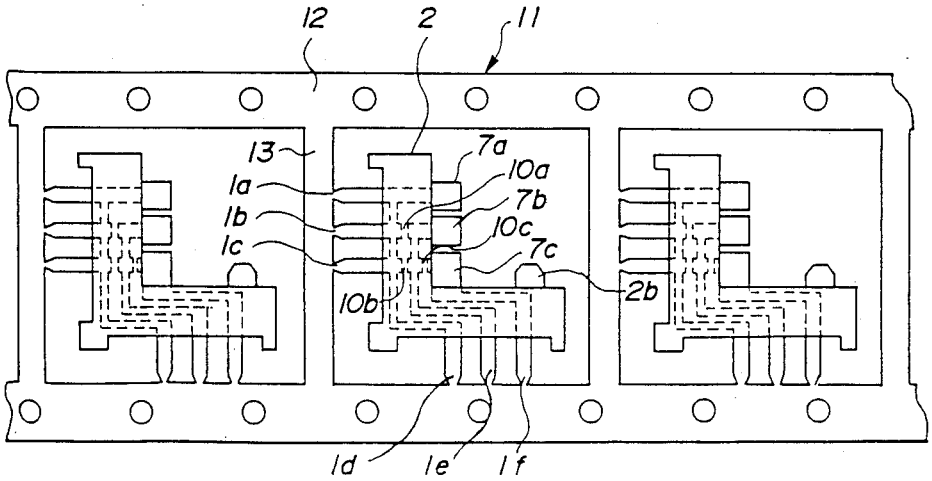
Figure 12A:
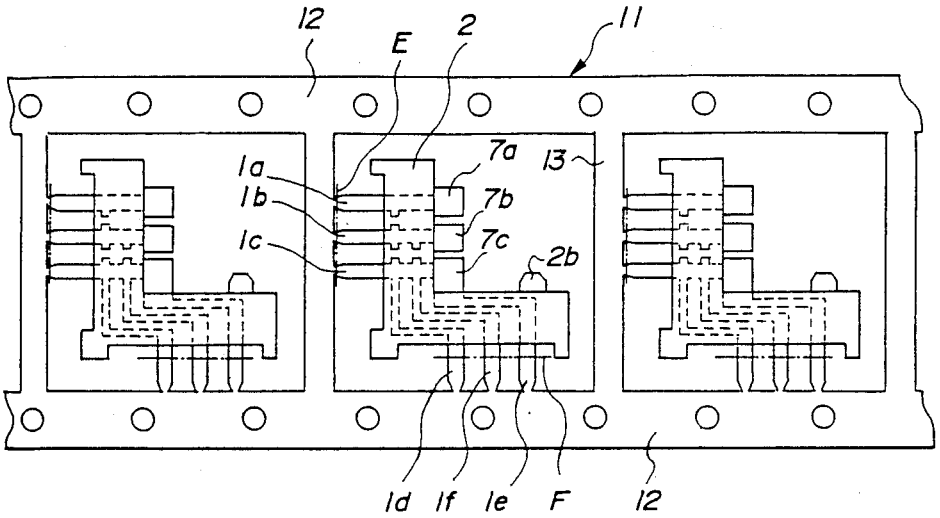
FIGS. 12*a* and 12*b* are similar views, and for horizontal and vertical types, respectively, indicate lines along which cutting is to be made so as to separate mold-with-terminal-pattern pieces from the metallic strip.
Figure 12B:
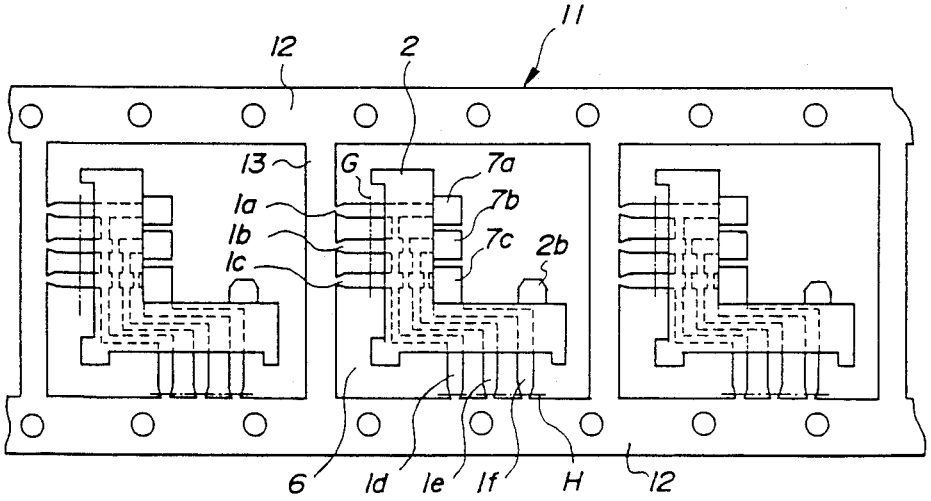

Following the completion of the above-stated cutting step, as the third step, molding is conducted with insulating synthetic resin such as polyphenylene sulfite (PPS), so that the terminal pattern 6 may be surrounded in the form of belt by the bracket-shaped mold (2) as illustrated in FIGS. 11a and 11b for the horizontal and vertical types, respectively. As understood from these drawings, both types are the same in apparence in the respect that the fixed contact elements 7a, 7b, 7c, and either terminal group 1a, 1b, 1c; or 1d, 1e, 1f are protruded, whereas there is a distinction between them in terminal pattern behind the mold 2 as described above. After completion of the molding, as the fourth step, as shown in FIG. 12, depending on the switch type, whether horizontal or vertical, terminal molded-pieces are separated form the strip edge 12 with advance boreholes and the ribs 13 for horizontal type, as shown in FIG. 12a, the ends of the terminals 1a, 1b contiguous to the rib 13 along line E, and the terminals 1d, 1e, 1f along line F near their bases. For vertical type, as shown in FIG. 12b, cutting is made along line G at the respective bases of the terminals 1a, 1b, 1c and along line H contiguous to the strip edge with advance boreholes. Thus the horizontal type has functional terminals 1a, 1b, 1c only and the vertical type has functional terminals 1d, 1e, 1f only.

Figure 13:
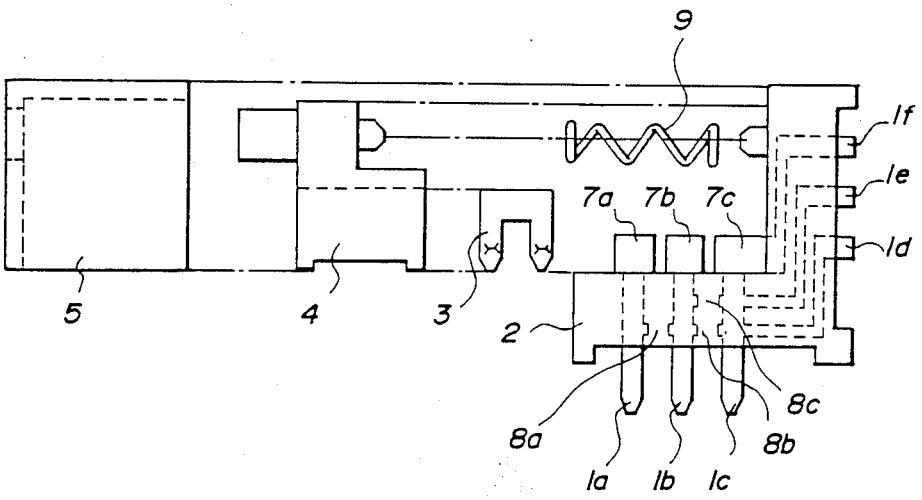
FIG. 13 is an exploded view illustrative of the assembly process for switch devices according to the invention.

In the fifth step of manufacture, each thus-obtained mold integrated with terminal pattern, as illustrated in FIG. 13, is installed with a compression spring 9, a movable contact element 3, a slide 4 in a predetermined arrangement. Finally a frame-work 5 is secured firmly to the mold 2 to obtain a completed switch device. The switch device shown in FIG. 13 is of horizontal type. A vertical-type switch device can be obtained with such a terminal molded-piece for the vertical type as above-mentioned, and compared with the horizontal type, is the same in appearance, except that the terminals 1d, 1e, 1f project at a right angle to the extending direction of the terminals 1a, 1b, 1c of the horizontal type.

Figure 14A:
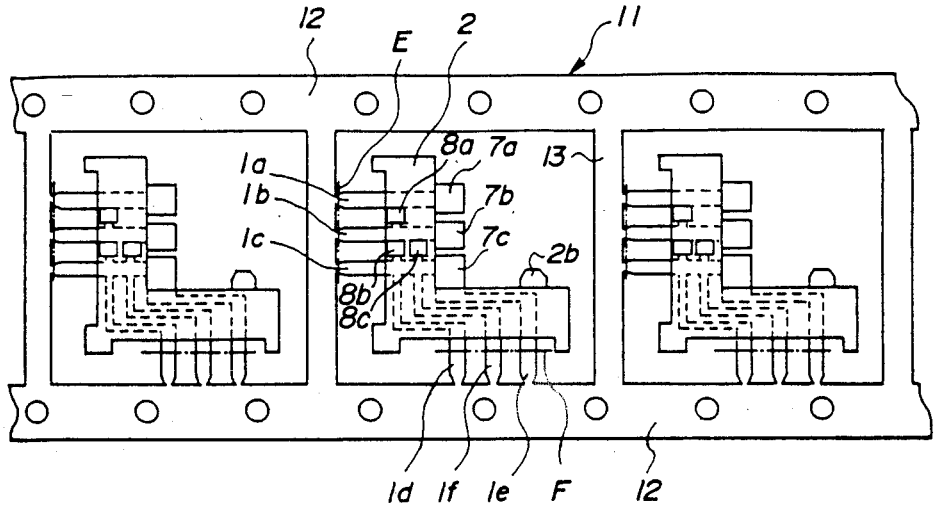
FIGS. 14*a* and 14*b* show an alternative method wherein the selected sites are cut after molding.
Figure 14B:
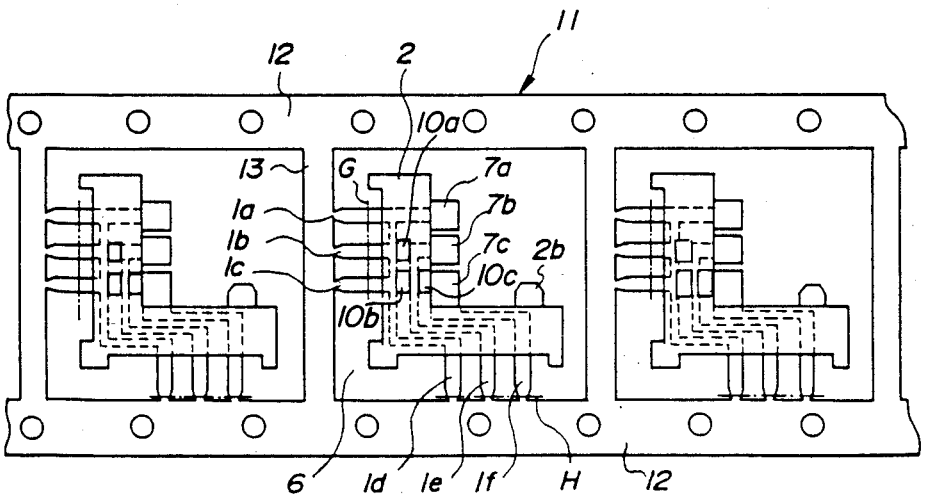

In the above-stated process for manufacturing horizontal or vertical types of switch device, the terminal pattern 6 is cut at the desired sites in accordance with the type of switch device before the molding. It however is essential that at the completion of the product, the predetermined sites in the terminal pattern have been cut to allow the fixed contact elements 7a, 7b, 7c to be connected only to the specified terminals. Thus there may be an alternative manufacturing process, which will be set forth below with reference to FIGS. 14a and 14b.

Firstly, a metallic conductive strip 11 is subjected to stamping to leave the same terminal pattern 6 as in the first step of the above-mentioned process, and directly molded as described above. In this case, it is preferable to make the molding so that the predetermined cutting sites in the terminal pattern 6 may remain exposed. After the molding, the above-mentioned passageways 8a, 8b, 8c; or the sites 10a, 10b, 10c of the terminals 1b, 1c with the mold covering the sites, are cut to allow the fixed contact elements 7a, 7b, 7c to connect only to the specified terminal group 1a, 1b, 1c; or 1d, 1e, 1f.

Substantially, in accordance with horizontal or vertical types, as in the above-mentioned fourth step, cutting is made to separate the terminal molded pieces from the strip edge portion 12 with advance boreholes and the ribs 13.

Each thus-obtained terminal molded piece having conductivity between the terminals 1a, 1b, 1c; or 1d, 1e, 1f and the corresponding fixed contact elements 7a, 7b, 7c is substantially installed with a compression spring 9, a movable contact element 3, a slide 4 and a frame 5 in the predetermined arrangement to obtain a completed switch device.

As described above, the superior feature of the invention resides in that either horizontal or vertical types of switch device can be obtained only by selecting the sites of the terminal pattern to be cut in accordance with a desired type.

Advantages of the invention

The switch device according to the invention, which is constructed as described above, can be manufactured with parts all of which are common to both horizontal and vertical types, with consequent great reduction in part cost. Further the process according to the invention is suitable for the manufacture of switch devices according to the invention, arbitrarily whether horizontal or vertical type, by selecting cutting sites in the terminal pattern, and this enables to establish a common steps and in turn a common line of manufacture, contributing to remarkable reduction in manufacturing cost.

What is claimed is:

1. A process of manufacturing horizontal and vertical type switch devices comprising the steps of:

(a) stamping a metallic, electrically conductive strip so as to form predetermined patterns therein, said patterns defining a set of common fixed contact elements, a first group of terminals extending from the fixed contact elements in a first direction, and a second group of terminals extending in a second direction perpendicular to the first direction, said second group of terminals being electrically connected to respective ones of said first group of terminals and said first group of terminals being electrically connected to respective ones of said fixed common contacts through interconnecting sites;

(b) cutting selected ones of said interconnecting sites so that one desired group of terminals remains electrically connected to the respective ones of said fixed contact elements;

(c) molding said strip in an insulating synthetic resin so that said two group of terminals have their respective ends projecting from respective sides thereof in said first and second directions;

(d) cutting the projecting ends of the group of terminals not electrically connected to said fixed contact elements and separating the molded unit of said fixed contact elements and remaining terminals from said metallic strip; and (e) installing a slide carrying a movable contact element and said molded unit in a frame such that said slide and movable contact element are positioned for operative sliding contact movement relative to said fixed contact elements so as to form the desired switch device.

2. A process of manufacturing horizontal and vertical type switch devices comprising the steps of:

(a) stamping a metallic, electrically conductive strip so as to form predetermined patterns therein, said patterns defining a set of common fixed contact elements, a first group of terminals extending from the fixed contact elements in a first direction, and a second group of terminals extending in a second direction perpendicular to the first direction, said second group of terminals being electrically connected to respective ones of said first group of terminals and said first group of terminals being electrically connected to respective ones of said fixed common contacts through interconnecting sites;

(b) molding said strip in an insulating synthetic resin so that said two group of terminals have their respective ends projecting from respective sides thereof in said first and second directions;

(c) cutting selected ones of said interconnecting sites so that one desired group of terminals remains electrically connected to the respective ones of said fixed contact elements;

(d) cutting the projecting ends of the group of terminals not electrically connected to said fixed contact elements and separating the molded unit of said fixed contact elements and remaining terminals from said metallic strip; and (e) installing a slide carrying a movable contact element and said molded unit in a frame such that said slide and movable contact element are positioned for operative sliding contact movement relative to said fixed contact elements so as to form the desired switch device.

3. A switch device of a desired horizontal or vertical type comprising:

a slide carrying a movable contact element;

a molded unit formed by a metallic, electrically conductive strip with predetermined patterns therein defining a set of common fixed contact elements, a first group of terminals extending from the fixed contact elements in a first direction, and a second group of terminals extending in a second direction perpendicular to the first direction, said second group of terminals being electrically connected to respective ones of said first group of terminals and said first group of terminals being electrically connected to respective ones of said fixed common contacts through interconnecting sites, said strip being molded in an insulating synthetic resin so that said two groups of terminals have their respective ends projecting from respective sides thereof in said first and second directions, wherein selected ones of said interconnecting sites are cut so that one desired group of terminals remains electrically connected to the respective ones of said fixed contact elements, and wherein the projecting ends of the other group of terminals not electrically connected to said fixed contact elements are cut off at said molded unit; and a frame in which said slide and said molded unit are installed such that said slide and movable contact element are positioned for operative sliding contact movement relative to said fixed contact elements so as to form the desired switch device.

* * * * *